US010249958B2

(12) United States Patent
Yang et al.

(10) Patent No.: US 10,249,958 B2
(45) Date of Patent: Apr. 2, 2019

(54) DISH ANTENNA AND METHOD FOR MANUFACTURING BRACKET THEREOF

(71) Applicant: Wistron NeWeb Corp., Hsinchu (TW)

(72) Inventors: Lan-Chun Yang, Hsinchu (TW); Chun-Wei Wang, Hsinchu (TW); Shun-Chung Kuo, Hsinchu (TW); San-Yi Kuo, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 170 days.

(21) Appl. No.: 15/416,445

(22) Filed: Jan. 26, 2017

(65) Prior Publication Data

US 2018/0212300 A1 Jul. 26, 2018

(51) Int. Cl.

| | |
|---|---|
| ***H01Q 15/16*** | (2006.01) |
| ***H01Q 1/12*** | (2006.01) |
| ***H01Q 3/06*** | (2006.01) |
| ***H01Q 3/02*** | (2006.01) |
| ***H01Q 19/13*** | (2006.01) |

(52) U.S. Cl.

CPC ..... *H01Q 15/16* (2013.01); *H01Q 1/12* (2013.01); *H01Q 1/125* (2013.01); *H01Q 1/1207* (2013.01); *H01Q 3/02* (2013.01); *H01Q 3/06* (2013.01); *H01Q 19/132* (2013.01)

(58) Field of Classification Search

CPC .... H01Q 1/1221; H01Q 19/13; H01Q 1/1207; H01Q 3/06; H01Q 15/16; H01Q 1/12

USPC ..... 343/880, 882, 890

See application file for complete search history.

(56) References Cited

U.S. PATENT DOCUMENTS

2001/0045912 A1* 11/2001 Liu ..... H01Q 1/125 343/882
2009/0243954 A1* 10/2009 Chen ..... H01Q 1/1221 343/878
2011/0193766 A1* 8/2011 Yang ..... H01Q 1/125 343/892
2014/0139390 A1* 5/2014 Whyte ..... H01Q 19/13 343/840

FOREIGN PATENT DOCUMENTS

TW 465812 U 11/2001

* cited by examiner

*Primary Examiner* — Hai V Tran

(74) *Attorney, Agent, or Firm* — McClure, Qualey & Rodack, LLP

(57) ABSTRACT

A dish antenna is provided. The dish antenna includes a dish, a bracket, a supporter and a receiver. The bracket is connected to the dish. The supporter is connected to the bracket. The receiver is connected to the supporter and corresponding to the dish. The bracket includes a base, a first wing plate, a second wing plate and a plurality of fastening portions. The base faces the dish. The bracket is affixed to the dish through the fastening portions. The first wing plate is disposed on a first side of the base. The second wing plate is disposed on a second side of the base. The first side is opposite to the second side. The first wing plate, the second wing plate and the fastening portions are integrally formed with the base.

15 Claims, 10 Drawing Sheets

C1

DISH ANTENNA AND METHOD FOR MANUFACTURING BRACKET THEREOF

BACKGROUND OF THE INVENTION

Field of the Invention

The present invention relates to a dish antenna, and in particular to a dish antenna having reduced cost.

Description of the Related Art

The conventional dish antenna includes a dish, a bracket, a supporter and a receiver. The bracket is cut and punched from a raw metal plate. The bracket includes two wing plates. The wing plates are fold along a longitudinal direction of the bracket. FIG. 11 shows the conventional bracket (spread out state) C1. Conventionally, as shown in FIG. 11, the dimensions of the raw metal plate (the wing plates are spread out in the longitudinal direction) are about 13 cm×51 cm. The supporter is a metal tube with a rectangular cross section. The supporter is formed by a punching and welding process.

In the conventional concept, when pressure is exerted on the dish antenna by the wind, the dish antenna must have sufficient structural strength, and the possibility to reduce the weight and the cost of the dish antenna is limited.

BRIEF SUMMARY OF THE INVENTION

An aspect of the present invention is to provide a dish antenna which includes a dish, a bracket, a supporter and a receiver. The bracket is connected to the dish. The supporter is connected to the bracket. The cross section of the supporter is in a U-shape. The receiver is connected to the supporter and corresponding to the dish. The bracket comprises a base, a first wing plate, a second wing plate and a plurality of fastening portions. An aspect of the base faces the dish. The bracket is affixed to the dish through the fastening portions. The first wing plate is disposed on a first side of the base. The second wing plate is disposed on a second side of the base. The first side is opposite to the second side. The first wing plate, the second wing plate and the fastening portions are integrally formed with the base.

Another aspect of the present invention is to provide a method for manufacturing a bracket, the method includes the following steps: providing a planar bracket substrate, in which the planar bracket substrate includes a base, a first wing plate, a second wing plate, two first fastening portions and two second fastening portions, the first wing plate and the first fastening portions are disposed on a first side of the base, the second wing plate and the second fastening portions are disposed on a second side of the base, and the first side is opposite to the second side; bending the first wing plate and the second wing plate to be perpendicular to the base; and punching the first fastening portions and the second fastening portions.

Another aspect of the present invention is to provide a dish stand assembly for mounting a satellite dish having a receiver. The dish stand assembly includes a bracket and a supporter. The bracket is connected to the satellite dish. The supporter is connected to the bracket, in which the cross section of the supporter is in a U-shape. The receiver is connected to the supporter and configured to be transmitting signals toward or receiving signals reflected from the satellite dish. The bracket includes a base, a first wing plate, a second wing plate and a plurality of fastening portions, an aspect of the base faces the dish, the bracket is adapted to be affixed to the dish through the fastening portions, the first wing plate is disposed on a first side of the base, the second wing plate is disposed on a second side of the base, the first side is opposite to the second side, and the first wing plate, the second wing plate and the fastening portions are integrally formed with the base.

Utilizing the embodiment of the invention, the first wing plate and the second wing plate are folded toward the transverse direction, namely about the longitudinal direction of the bracket. Therefore, the dimensions of the planar bracket substrate (raw metal plate) are decreased, the cost of the bracket is reduced, and the structural strength thereof is maintained.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
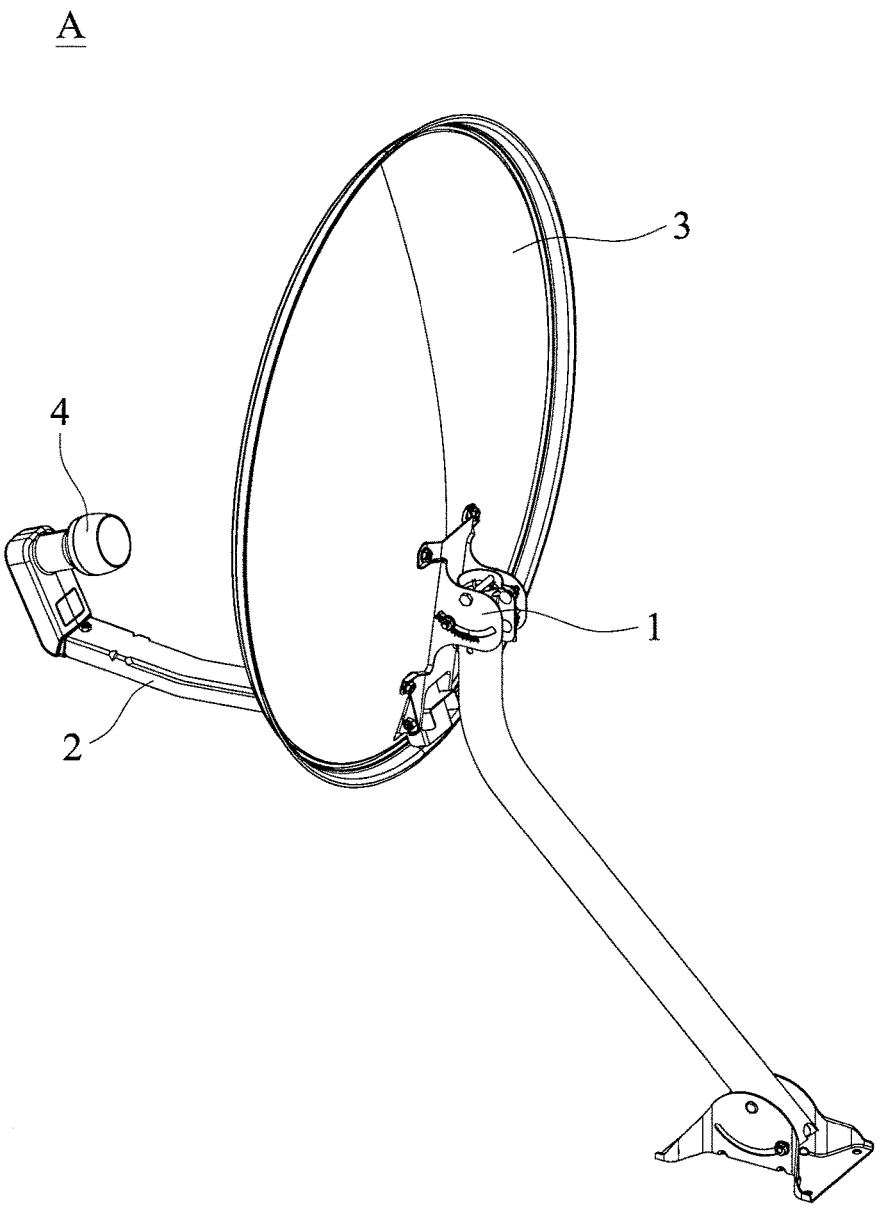
FIG. 1 shows a dish antenna according to an embodiment of the invention.
Figure 2:
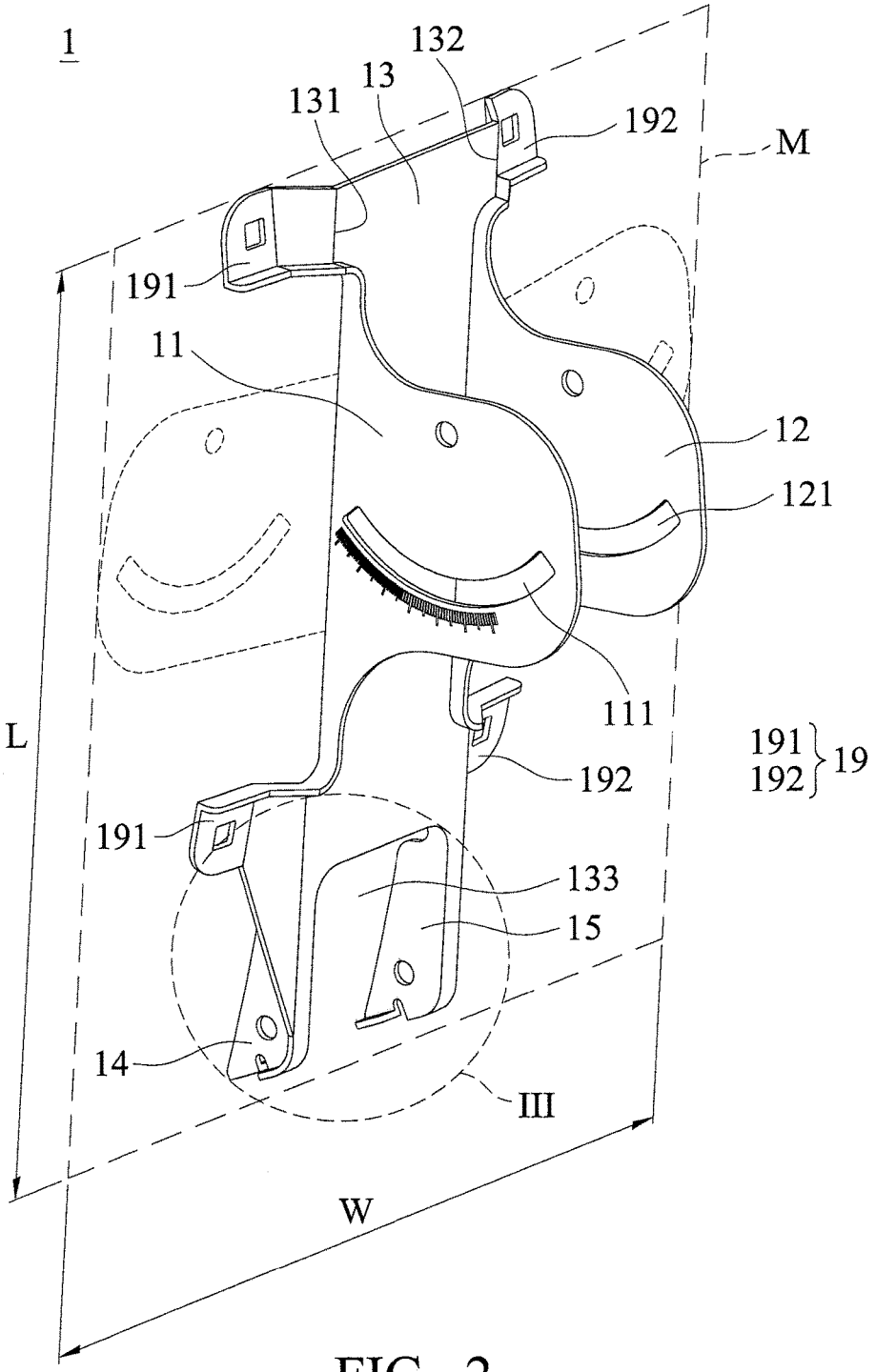
FIG. 2 shows a bracket according to an embodiment of the invention.

FIG. 1 shows a dish antenna A of an embodiment of the invention. The dish antenna A includes a dish 3, a bracket 1, a supporter 2 and a receiver 4. The bracket 1 is connected to the dish 3. The supporter 2 is connected to the bracket 1. The receiver 4 is connected to the supporter 2 and corresponds to the dish 3. With reference to FIG. 2, the bracket 1 includes a base 13, a first wing plate 11, a second wing plate 12 and a plurality of fastening portions 19. An aspect of the base 13 faces the dish 3. The bracket 1 is affixed to the dish 3 through the fastening portions 19. The first wing plate 11 is disposed on a first side 131 of the base 13. The second wing plate 12 is disposed on a second side 132 of the base 13. The first side 131 is opposite to the second side 132. The first wing plate 11, the second wing plate 12 and the fastening portions 19 are integrally formed with the base 13.

With reference to FIG. 2, in one embodiment, the base 13 is substantially a planar structure. The fastening portions 19 include two first fastening portions 191 and two second fastening portions 192. The first fastening portions 191 are directly connected to the first side 131 of the base 13. The second fastening portions 192 are directly connected to the second side 132 of the base 13. In one embodiment, the base 13 has a curved surface matching the curvature of the dish. 3

With reference to FIG. 2, in one embodiment, a first orientation adjusting slot 111 is formed on the first wing plate 11. A second orientation adjusting slot 121 is formed on the second wing plate 12. The first wing plate 11 and the second wing plate 12 are perpendicular to the base 13.

Figure 3:
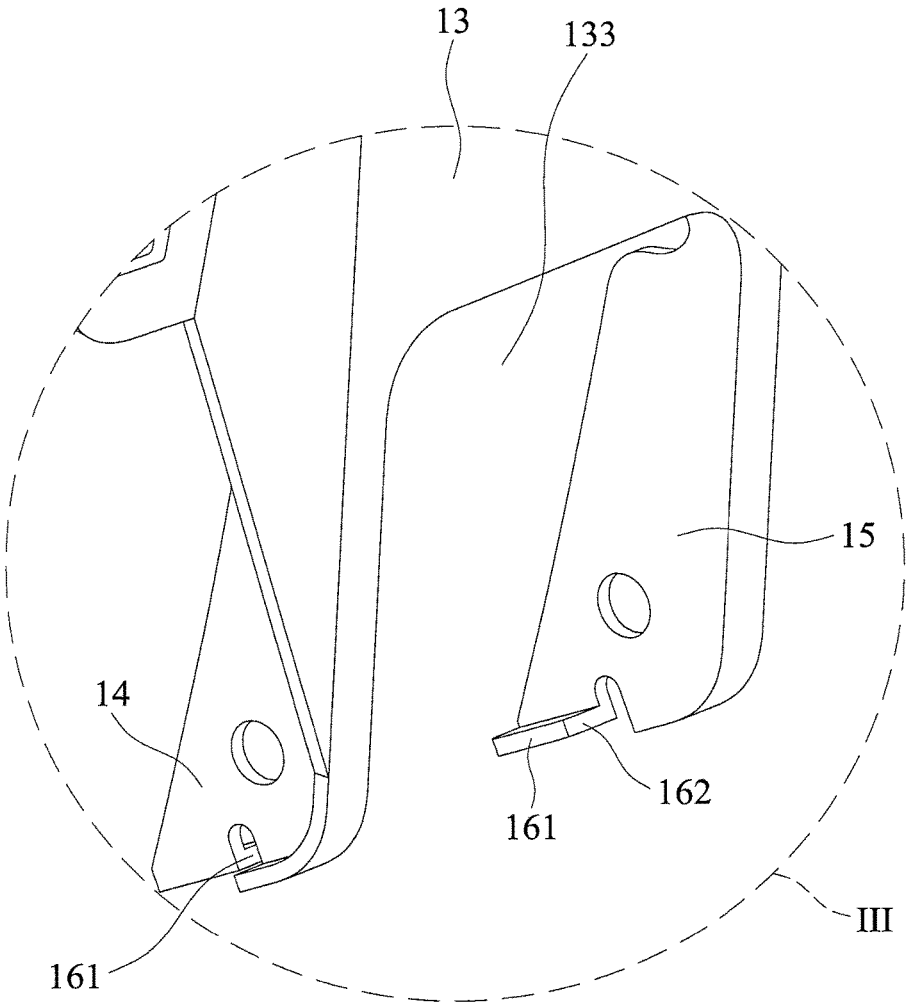
FIG. 3 is an enlarged view of the portion III of FIG. 2.

FIG. 3 is an enlarged view of portion III of FIG. 2. With reference to FIGS. 2 and 3, in one embodiment, the bracket 1 includes a first shaft connection portion 14 and a second shaft connection portion 15. The base 13 comprises a notch 133. The first shaft connection portion 14 and the second shaft connection portion 15 are integrally extended from the base 13 and formed on two sides of the notch 133.

With reference to FIG. 2, the bracket 1 of the embodiment of the invention is cut and punched from a raw metal plate with dimensions of L (length)×W (width). In a leveling state, the first wing plate 11 and the second wing plate 12 are spread out in the transverse direction of the bracket 1. Therefore, utilizing the bracket 1 of the embodiment of the invention, the dimensions of the raw metal plate can be reduced to 20 cm×25 cm, and the thickness of the raw metal plate can remain unchanged. Compared to conventional bracket spread out in the longitudinal direction, the embodiment of the invention reduces the amount of material required, and maintains qualified structural strength. The value data disclosed above is used as an example, which is not meant to restrict the invention. Comparing to the conventional bracket spread out in the longitudinal direction for supporting the dish of the same dimensions, the weight of the bracket 1 spread out in the transverse direction according to the embodiment of the invention can be reduced by 34%, and the weight of the raw metal plate according to the embodiment of the invention (before cut off) can be reduced by 26%.

Figure 4:
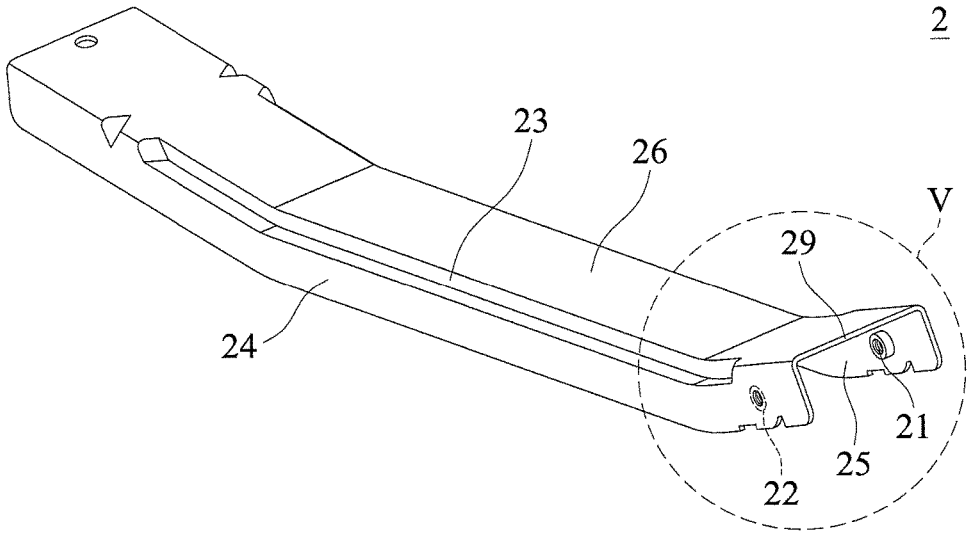
FIG. 4 shows a supporter according to an embodiment of the invention.
Figure 5:
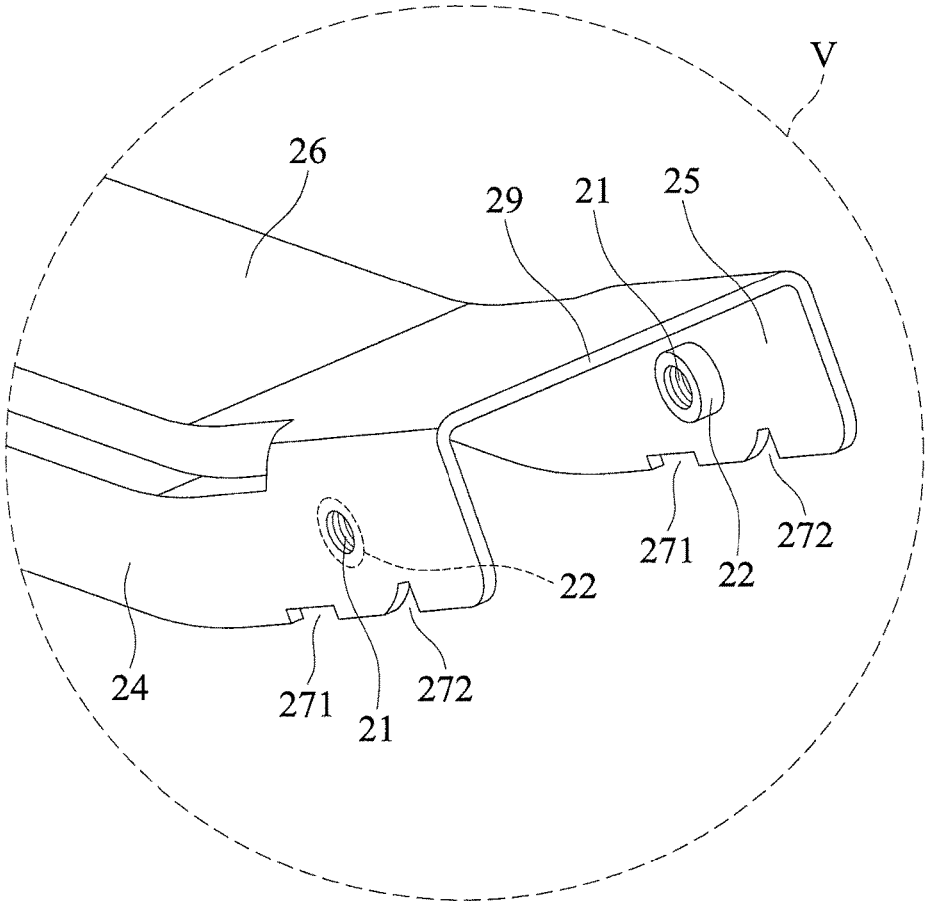
FIG. 5 is the enlarged view of the portion V of FIG. 4.
Figure 6:
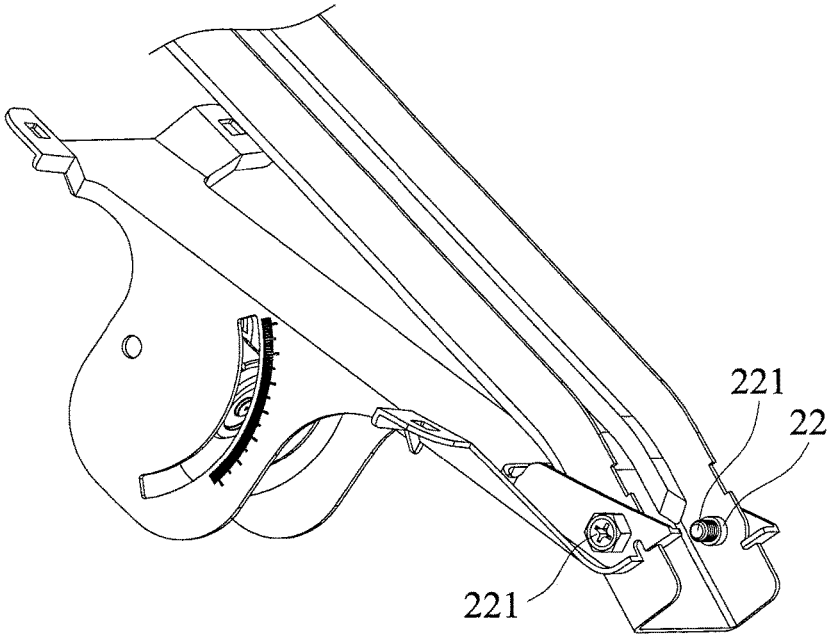
FIG. 6 shows the bolts passing through the openings and being fastened to the threaded portions according to an embodiment of the invention.

FIG. 4 shows the supporter of an embodiment of the invention. FIG. 5 is an enlarged view of portion V of FIG. 4. With reference to FIGS. 4 and 5, in one embodiment, the supporter 2 includes a U-shaped cross section 29. In one embodiment, the supporter 2 further includes two openings 21 and two threaded portions 22. The threaded portions 22 correspond to the respective openings 21. The threaded portions 22 are integrally formed on an inner side of the supporter 2. FIG. 6 shows bolts 221 that are passing through the openings 21 and are fastened to the threaded portions 22. The threaded portions 22 can be utilized as nuts, and provide advantages such as being combined easily and reducing the number of elements required.

With reference to FIGS. 4 and 5, in one embodiment, the supporter 2 further includes at least one strengthening groove 23. The strengthening groove 23 extends along the longitudinal direction of the supporter 2, and is located between the bracket 1 and the receiver 4. In one embodiment, the supporter 2 includes a first side wall 24, a second side wall 25 and the top wall 26. The first side wall 24 and the second side wall 25 are formed on two sides of the top wall 26. In this embodiment, the number of the strengthening grooves 23 is two. One of the strengthening grooves 23 is formed in the location where the first side wall 24 is connected to the top wall 26, and another strengthening groove 23 is formed in the location where the second side wall 25 is connected to the top wall 26.

Experiment confirms that when the dish antenna experiences wind pressure, the vibration of the dish 3 applied to the bracket 1 and the supporter 2 damages the dish antenna. Therefore, the structural strength of the portion of the supporter 2 connected to the bracket 1 is crucial. The supporter 2 does not need to be tube-shaped, whereas conventional supporters do, in order to bear the wind pressure applied to the supporter while in use. According to an embodiment of the invention, the supporter 2 with the U-shaped cross section is formed by a punch, so that the cost of welding for closing up a metal sheet to form a tube-shaped supporter is therefore eliminated. Additionally, the integrally formed threaded portions 22 are formed on the inner side of the supporter 2 to replace conventional nuts, and the strengthening grooves 23 increase the strength of the supporter 2. In one embodiment, the thickness of the material of the supporter 2 can be 1.6 times of the thickness of the material of the conventional supporter to increase the structural strength of the supporter.

Figure 7:
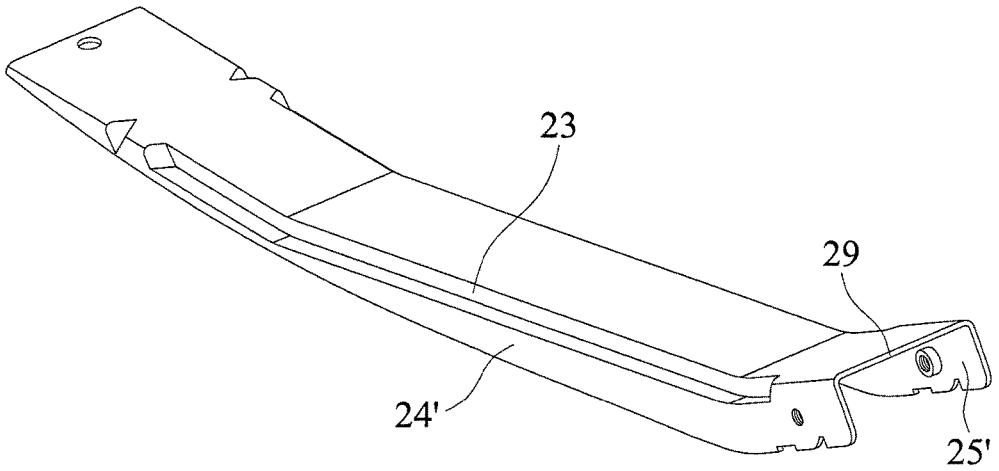
FIG. 7 shows a supporter according to an embodiment of the invention.

With reference to FIG. 7, in a modified example, the weight of the supporter 2 can be further reduced and so does the cost. For example, the width of the first side wall 24' and the width of the second side wall 25' narrow gradually from the bracket 1 to the receiver 4.

Figure 8:
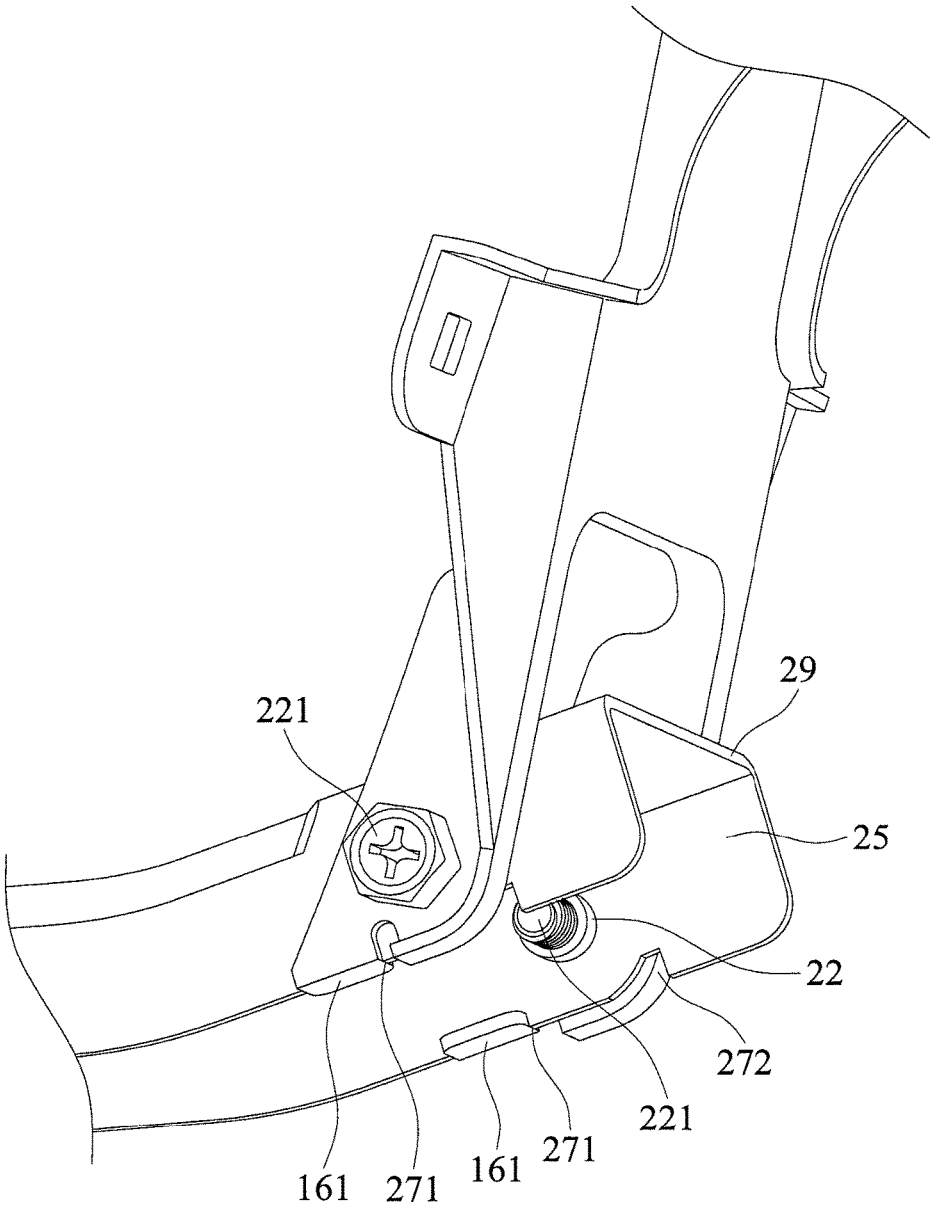
FIG. 8 shows a plurality of supporter stopping notches respectively abutting against both sides of the bracket stoppers in an installation state according to an embodiment of the invention.

With reference to FIGS. 3 and 5, in one embodiment, the supporter 2 includes a plurality of supporter stopping notches 271. The bracket 1 includes a plurality of bracket stoppers 161. The bracket stoppers 161 are respectively formed on the first shaft connection portion 14 and the second shaft connection portion 15. With reference to FIG. 8, in an installation state, the respective supporter stopping notches 271 abut against the two sides of the bracket stoppers 161.

Figure 9:
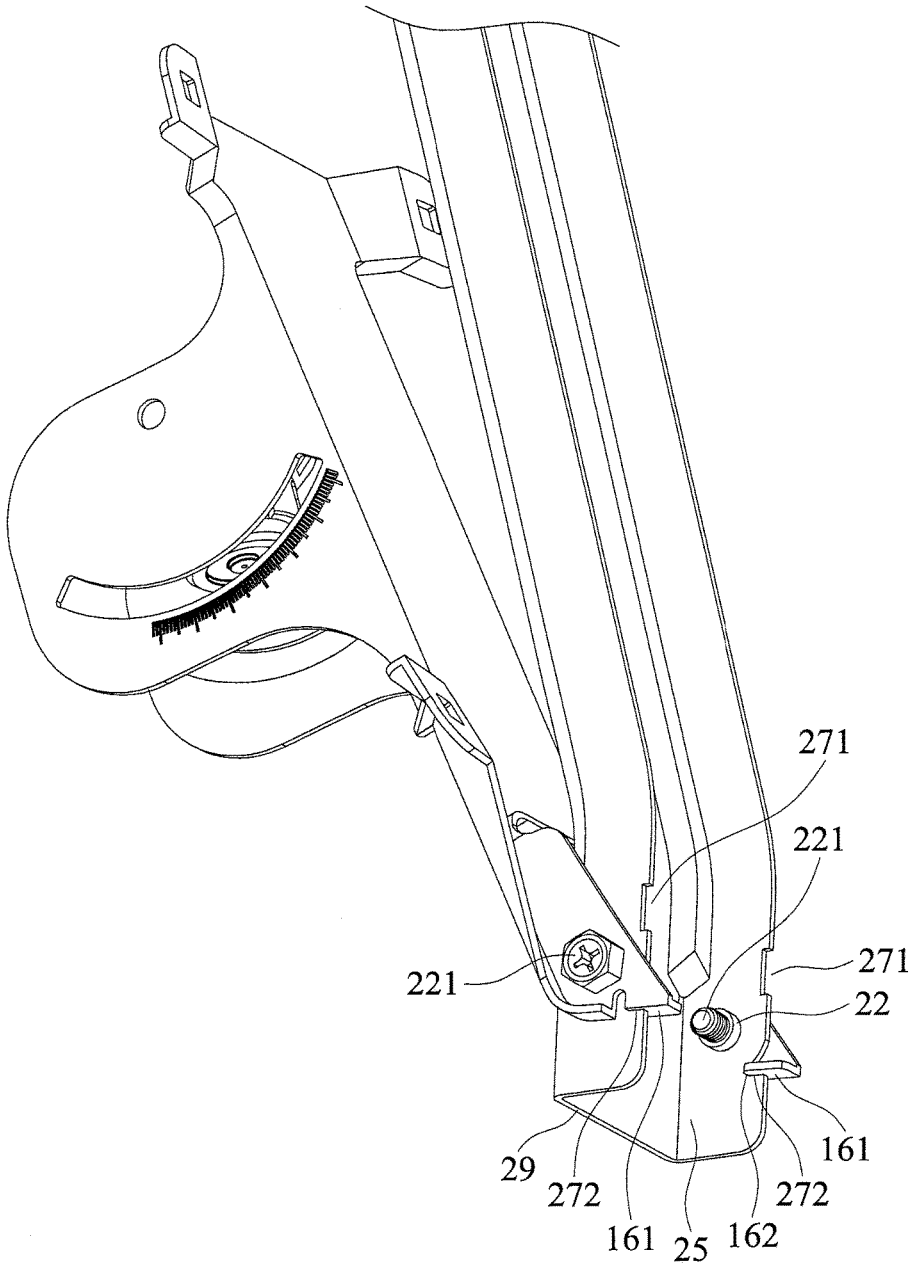
FIG. 9 shows a plurality of rotation stopping notches respectively abutting against the rotation stopping portions in a folded state according to an embodiment of the invention.

With reference to FIGS. 3 and 5, in one embodiment, the supporter 2 includes a plurality of rotation stopping notches 272. Each bracket stopper 161 includes a rotation stopping portion 162. With reference to FIG. 9, in a folded state, the rotation stopping notches 272 abut against the respective rotation stopping portions 162 (one side of the bracket stopper 161).

Figure 10:
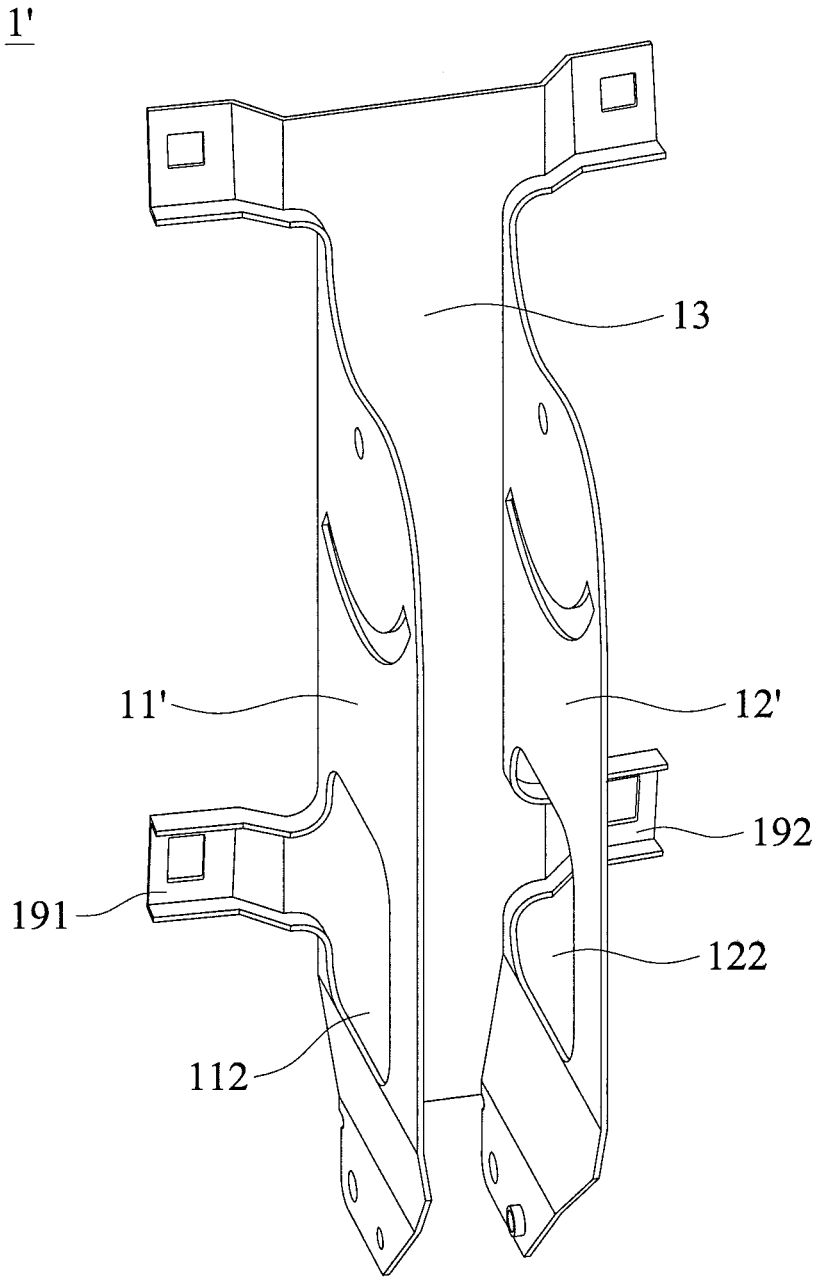
FIG. 10 shows a bracket according to another embodiment of the invention.
Figure 11:
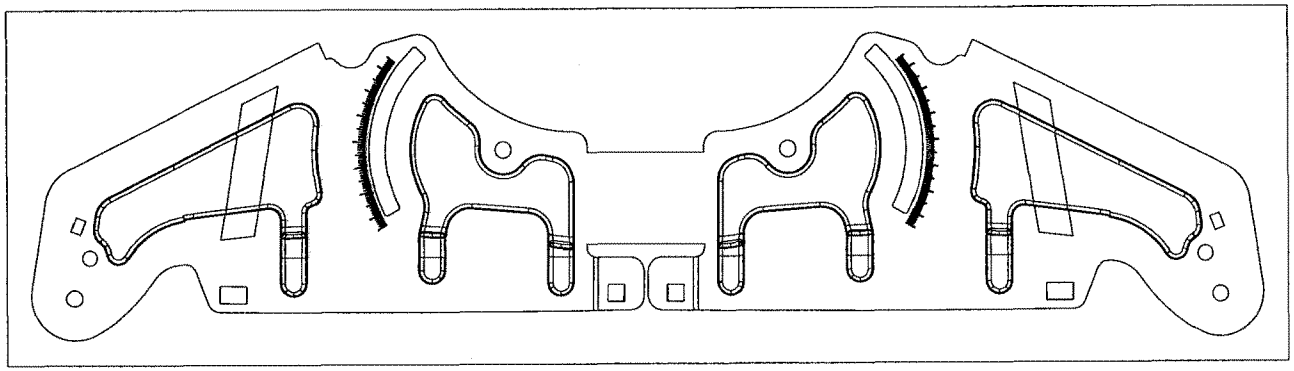
FIG. 11 ( PRIOR ART )
FIG. 11 shows a conventional bracket spread out in a direction.

FIG. 10 shows a bracket 1' of another embodiment of the invention, wherein the first wing plate 11' has a first opening 112, and the second wing plate 12' has a second opening 122. The first opening 112 is corresponding to the first fastening portions 191 on a side of the base 13, and the second opening 122 is corresponding to the second fastening portions 192 on another side of the base 13. In this embodiment, the lengths of the portions where the first wing plate 11' and the second wing plate 12' connect to the base 13 are elongated longitudinally, and the structural areas of the first wing plate 11' and the second wing plate 12' are therefore increased. As a result the structural strength of the bracket is significantly enhanced. In one embodiment, the bracket 1' of the embodiment of the invention is cut and punched from a raw metal plate with dimensions of 20 cm×25 cm. Compared to the bracket 1 of the previous embodiment, the bracket 1' of this embodiment utilizes the raw metal plate of the same cost and provides improved structural strength.

In one embodiment, a method for manufacturing a bracket is provided, which includes the following steps. First, a planar bracket substrate (raw metal plate) is provided. The planar bracket substrate includes a base, a first wing plate, a second wing plate, two first fastening portions and two second fastening portions. The first wing plate and the first fastening portions are disposed on a first side of the base. The second wing plate and the second fastening portions are disposed on a second side of the base. The first side is opposite to the second side. Next, the first wing plate and the second wing plate are bent to be perpendicular to the base. Then, the first fastening portions and the second fastening portions are punched. In one embodiment, the first wing plate and the second wing plate are folded toward the transverse direction of the bracket (the transverse direction is also the direction which the first wing plate and the second wing plate face to each other). The bracket further includes a first shaft connection portion and a second shaft connection portion, the base includes a notch, the first shaft connection portion and the second shaft connection portion are integrally extended from the base and formed on two sides of the notch. In one embodiment, the method further includes the step of bending the first shaft connection portion and the second shaft connection portion to be perpendicular to the base, in which a bending direction of the first shaft connection portion is opposite to a bending direction of the first wing plate, and a bending direction of the second shaft connection portion is opposite to a bending direction of the second wing plate.

Utilizing the method for manufacturing a bracket of the embodiment of the invention, where the first wing plate and the second wing plate are folded toward the transverse direction of the bracket, the dimensions of the planar bracket substrate (raw metal plate) are reduced, the cost of the bracket is reduced as well, and without scarifying the overall structural strength.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A dish antenna, comprising:

a dish;

a bracket, connected to the dish;

a supporter, connected to the bracket, wherein the cross section of the supporter is in a U-shape and has a first side wall, a second side wall opposite to the first side wall, and a top wall connecting the first side wall and the second side wall, wherein at least one strengthening groove is defined where the top wall joins at least one of the first side wall or the second side wall and extends along a longitudinal direction of the supporter; and a receiver, connected to the supporter and corresponding to the dish, wherein the bracket comprises a base, a first wing plate, a second wing plate and a plurality of fastening portions, an aspect of the base faces the dish, the bracket is affixed to the dish through the fastening portions, the first wing plate is disposed on a first side of the base, the second wing plate is disposed on a second side of the base, the first side is opposite to the second side, and the first wing plate, the second wing plate and the fastening portions are connected with the base.

2. The dish antenna as claimed in claim 1, wherein a first orientation adjusting slot is formed on the first wing plate, a second orientation adjusting slot is formed on the second wing plate, and the first wing plate and the second wing plate are perpendicular to the base.

3. The dish antenna as claimed in claim 1, wherein the supporter further comprises two openings and two threaded portions corresponded to the respective openings, and the threaded portions are integrally formed on an inner side of the supporter.

4. The dish antenna as claimed in claim 1, wherein a width of the first side wall and a width of the second side wall are gradually narrowed along a direction from the bracket to the receiver.

5. The dish antenna as claimed in claim 1, wherein the bracket comprises a first shaft connection portion and a second shaft connection portion, the base comprises a notch, and the first shaft connection portion and the second shaft connection portion are integrally extended from the base and formed on two sides of the notch.

6. The dish antenna as claimed in claim 5, wherein the supporter comprises a plurality of supporter stopping notches, the bracket comprises a plurality of bracket stoppers, the bracket stoppers are respectively formed on the first shaft connection portion and the second shaft connection portion, the supporter stopping notches abut against the corresponding bracket stoppers in an installation state.

7. The dish antenna as claimed in claim 6, wherein the supporter comprises a plurality of rotation stopping notches, each bracket stopper comprises a rotation stopping portion, the rotation stopping notches abut against the corresponding rotation stopping portions in a folded state.

8. The dish antenna as claimed in claim 1, wherein the base is a planar structure, the fastening portions comprise two first fastening portions and two second fastening portions, the first fastening portions are directly connected to the first side of the base, and the second fastening portions are directly connected to the second side of the base.

9. A dish stand assembly for mounting a satellite dish having a receiver, the dish stand assembly comprising:

a bracket, connected to the satellite dish; and a supporter, connected to the bracket, wherein the cross section of the supporter is in a U-shape and has a first side wall, a second side wall opposite to the first side wall, and a top wall connecting the first side wall and the second side wall, wherein at least one strengthening groove is defined where the top wall joins at least one of the first side wall or the second side wall and extends along a longitudinal direction of the supporter;

wherein the receiver is connected to the supporter and configured to be transmitting signals toward or receiving signals reflected from the satellite dish;

wherein the bracket comprises a base, a first wing plate, a second wing plate and a plurality of fastening portions, an aspect of the base faces the dish, the bracket is adapted to be affixed to the dish through the fastening portions, the first wing plate is disposed on a first side of the base, the second wing plate is disposed on a second side of the base, the first side is opposite to the second side, and the first wing plate, the second wing plate and the fastening portions are connected with the base.

10. The dish antenna as claimed in claim 9, wherein a first orientation adjusting slot is formed on the first wing plate, a second orientation adjusting slot is formed on the second wing plate, and the first wing plate and the second wing plate are perpendicular to the base.

11. The dish antenna as claimed in claim 9, wherein a width of the first side wall and a width of the second side wall are gradually narrowed along a direction from an end close to the bracket toward another end away from the bracket.

12. The dish antenna as claimed in claim 9, wherein the bracket comprises a first shaft connection portion and a second shaft connection portion, the base comprises a notch, and the first shaft connection portion and the second shaft connection portion are integrally extended from the base and formed on two sides of the notch.

13. The dish antenna as claimed in claim 12, wherein the supporter comprises a plurality of rotation stopping notches, each bracket stopper comprises a rotation stopping portion, the rotation stopping notches abut against the corresponding rotation stopping portions in a folded state.

14. The dish antenna as claimed in claim 9, wherein the base is a planar structure, the fastening portions comprise two first fastening portions and two second fastening portions, the first fastening portions are directly connected to the first side of the base, and the second fastening portions are directly connected to the second side of the base.

15. A dish stand assembly for mounting a satellite dish having a receiver, the dish stand assembly comprising:

a bracket, connected to the satellite dish; and a supporter, connected to the bracket, wherein the cross section of the supporter is in a U-shape;

wherein the receiver is connected to the supporter and configured to be transmitting signals toward or receiving signals reflected from the satellite dish;

wherein the bracket comprises a base, a first wing plate, a second wing plate and a plurality of fastening portions, an aspect of the base faces the dish, the bracket is adapted to be affixed to the dish through the fastening portions, the first wing plate is disposed on a first side of the base, the second wing plate is disposed on a second side of the base, the first side is opposite to the second side, and the first wing plate, the second wing plate and the fastening portions are integrally formed with the base, wherein the bracket comprises a first shaft connection portion and a second shaft connection portion, the base comprises a notch, and the first shaft connection portion and the second shaft connection portion are integrally extended from the base and formed on two sides of the notch, wherein the supporter comprises a plurality of supporter stopping notches, the bracket comprises a plurality of bracket stoppers, the bracket stoppers are respectively formed on the first shaft connection portion and the second shaft connection portion, the supporter stopping notches abut against the corresponding bracket stoppers in an installation state.

* * * * *